US012292188B2

(12) United States Patent
Noritake

(10) Patent No.: US 12,292,188 B2
(45) Date of Patent: May 6, 2025

(54) PREMIXING APPARATUS

(71) Applicant: RINNAI CORPORATION, Aichi (JP)

(72) Inventor: Katsuya Noritake, Aichi (JP)

(73) Assignee: RINNAI CORPORATION, Aichi (JP)

( * ) Notice: Subject to any disclaimer, the term of this patent is extended or adjusted under 35 U.S.C. 154(b) by 440 days.

(21) Appl. No.: 18/056,921

(22) Filed: Nov. 18, 2022

(65) Prior Publication Data

US 2023/0184426 A1 Jun. 15, 2023

(30) Foreign Application Priority Data

Dec. 14, 2021 (JP) ..... 2021-202855

(51) Int. Cl.
*F23D 14/62* (2006.01)
*F23D 14/04* (2006.01)
*F23D 14/60* (2006.01)

(52) U.S. Cl.
CPC ..... *F23D 14/04* (2013.01); *F23D 14/60* (2013.01); *F23D 14/62* (2013.01)

(58) Field of Classification Search
CPC ..... F23D 14/04; F23D 14/06; F23D 14/62
USPC ..... 431/354
See application file for complete search history.

(56) References Cited

U.S. PATENT DOCUMENTS 12,055,292 B2 * 8/2024 Noritake ..... F23D 14/02
2021/0041100 A1 2/2021 Noritake et al.
2023/0112151 A1 * 4/2023 Noritake ..... F23N 1/065 60/737

FOREIGN PATENT DOCUMENTS

JP 2018-179447 A 11/2018
JP 2021-025722 A 2/2021

* cited by examiner

*Primary Examiner* — Avinash A Savani
(74) *Attorney, Agent, or Firm* — Future IP LLC; Tomoko Nakajima

(57) ABSTRACT

In a premixing apparatus that mixes a fuel gas with air, supplies an air-fuel mixture to a burner through a fan, and carries out a control that regulates an opening degree of a variable throttle valve, which is interposed in a gas supply passage, so that an excess air ratio of an air-fuel mixture becomes an appropriate value, in a case where a detected excess air ratio deviates to one side, e.g., a large side, from an acceptable range, a motor is repeatedly caused to rotate by a unit-angle in an opening-degree increasing direction until the detected excess air ratio becomes an appropriate value. In a case where the detected air ratio deviates to the other side, e.g., a small side, from the acceptable range, the motor is caused to rotate, at a high speed in an opening-degree decreasing direction, till a first position that is anticipated that the excess air ratio will become a value that deviates by a fixed quantity from the acceptable range to a large side, thereafter, the motor is caused to rotate, at the high speed in an opening-degree increasing direction, till a second position that is a short of a target position, and subsequently, the motor is caused to rotate by the unit-angle in the opening-increasing direction.

3 Claims, 3 Drawing Sheets

PREMIXING APPARATUS

TECHNICAL FIELD

The invention relates to a premixing apparatus that mixes a fuel gas with air and supplies an air-fuel mixture to a burner through a fan.

BACKGROUND ART

There has been conventionally known one of the premixing apparatuses, which includes an air supply passage on an upstream side of the fan, a gas supply passage of which a downstream end is connected to a gas suction part that is arranged in the air supply passage, and a zero governor that is interposed in the gas supply passage and regulates a secondary gas pressure to an atmospheric pressure (See patent document No. 1, for example). Here, a supply amount of the fuel gas varies depending on a differential pressure between the atmospheric pressure that is the secondary gas pressure and a negative pressure that acts upon the gas suction part. Since the negative pressure that acts upon the gas suction part varies depending on a fan rotational speed, the supply amount of the fuel gas varies in proportion to the fan rotational speed, i.e., a supply amount of air. Accordingly, by controlling the fan rotational speed corresponding to a required combustion amount, the air-fuel mixture in an amount corresponding to the required combustion amount is supplied to the burner and an excess air ratio of the air-fuel mixture (a primary air amount/a stoichiometric air amount) becomes constant.

Incidentally, even if a same kind of a gas is used as the fuel gas, a calorific amount (Wobbe Index) of the fuel gas sometimes fluctuates with time. In the above-mentioned premixing apparatus, even in a case where the calorific amount of the fuel gas fluctuates, a ratio of the supply amount of the fuel gas to the supply amount of the air remains constant. Therefore, an excess air ratio of the air-fuel mixture varies due to fluctuation of the calorific amount of the fuel gas and poor combustion occurs.

Then, there has been conventionally known another premixing apparatus that includes: a variable throttle valve that is interposed in a portion, on a downstream side of the zero governor, of the gas supply passage and is driven by a stepping motor; and an excess air ratio detecting device that detects the excess air ratio of the air-fuel mixture. The premixing apparatus is also configured to carry out a control that regulates an opening degree of the variable throttle valve so that the excess air ratio of the air-fuel mixture, which is detected by the excess air ratio detecting device, becomes constant (See patent document No. 2, for example).

Here, on a premise that a rotational direction of the stepping motor, which causes the opening degree of the variable throttle valve to change to one of an increase and a decrease, is defined as a normal-rotation direction and a rotational direction of the stepping motor, which causes the opening degree of the variable throttle valve to change to the other of the increase and the decrease, is defined as a reversal direction, a change characteristic line of the reversal direction, which expresses a relationship between a rotational position of the stepping motor and the opening degree of the variable throttle valve when the stepping motor is caused to rotate in the reversal direction, deviates from a change characteristic line of the normal-rotation direction, which expresses a relationship between the rotational position of the stepping motor and the opening degree of the variable throttle valve when the stepping motor is caused to rotate in the normal-rotation direction, by a hysteresis amount in the reversal direction according to backlash of a driving mechanism from the stepping motor to a valve body of the variable throttle valve. Then, in a case where the opening degree of the variable throttle valve at time of immediately previous regulation was changed to the above-mentioned one, for example, and in a present regulation, in a case where it is necessary for the opening degree of the variable throttle valve to be changed to the above-mentioned other, even by causing the stepping motor to rotate in the reversal direction, as long as a rotational angle falls within the hysteresis amount, the opening degree of the variable throttle valve is not be changed. Therefore, in order to reduce time that is took for opening-degree regulation of the variable throttle valve, it becomes necessary for the stepping motor to be quickly caused to rotate by the hysteresis amount in the reversal direction.

Incidentally, there is an individual difference in the hysteresis amount and the hysteresis amount varies with time. Therefore, when the opening degree of the variable throttle valve has begun to change to the above-mentioned other before the rotational angle of the stepping motor in the reversal direction reaches a predetermined hysteresis amount, the opening degree of the variable throttle valve sometimes changes excessively to the above-mentioned other. In this case, it is necessary for the opening degree of the variable throttle valve to be changed to the above-mentioned one by rotation of the stepping motor in the normal-rotation direction. Further, at time when the stepping motor is quickly caused to rotate by the predetermined hysteresis amount in the normal-rotation direction, the opening degree of the variable throttle valve excessively changes to the above-mentioned one and it sometimes becomes necessary for the opening degree of the variable throttle valve to be changed to the above-mentioned other again. As a result, since changes of the opening degree of the variable throttle valve to the above-mentioned other and one are repeated, there is possibility that it takes time to regulate the variable throttle valve.

REFERENCE

Patent document No. 1: JPA 2018-179447
Patent document No. 2: JPA 2021-025722

SUMMARY OF INVENTION

Technical Problem

In the light of the above-mentioned problem, the invention provides a premixing apparatus that can prevent much time from being took for regulation of a variable throttle valve due to a change of a hysteresis amount.

Solution to Problem

In order to solve the above-mentioned problem, the invention presupposes a premixing apparatus that mixes a fuel gas with air and supplies an air-fuel mixture to a burner through a fan includes: an air supply passage on an upstream side of the fan; a gas supply passage of which a downstream end is connected to a gas suction part that is arranged in the air supply passage; a zero governor that is interposed in the gas supply passage and regulates a secondary gas pressure to an atmospheric pressure; a variable throttle valve that is interposed in a portion, on a downstream side of the zero governor, of the gas supply passage and is driven by a stepping motor; an excess air ratio detecting device that detects an excess air ratio of the air-fuel mixture; and a control device that is configured to carry out a first control that is able to change a rotational speed of the fan depending on a required combustion amount and a second control that regulates an opening degree of the variable throttle valve so that the excess air ratio of the air-fuel mixture, which is detected by the excess air ratio detecting device, becomes a predetermined value. In the invention, on a premise that a rotational direction of the stepping motor, which causes the opening degree of the variable throttle valve to change to one of an increase and a decrease, is defined as a normal-rotation direction and a rotational direction of the stepping motor, which causes the opening degree of the variable throttle valve to change to the other of the increase and the decrease, is defined as a reversal direction, the control device is configured to carry out: a third control as the second control, which, in a case where the excess air ratio of the air-fuel mixture, which is detected by the excess air ratio detecting device, has been a value that is out of a predetermined acceptable-range which includes the appropriate value and will become the appropriate value by causing the opening degree of the variable throttle valve to change to the above-mentioned one, at a state where the stepping motor has been caused to rotate by a predetermined unit-angle in the normal-rotation direction, repeatedly distinguishes whether the excess air ratio of the air-fuel mixture, which is detected by the excess air ratio detecting device, has become the appropriate value until the excess air ratio of the air-fuel mixture, which is detected by the excess air ratio detecting device, becomes the appropriate value; and a fourth control as the second control, which, in a case where the excess air ratio of the air-fuel mixture, which is detected by the excess air ratio detecting device, has been a value that is out of the acceptable-range and will become the appropriate value by causing the opening degree of the variable throttle valve to change to the above-mentioned other, causes the stepping motor to rotate in the reversal direction till a predetermined first standard rotational-position that is set based on a change characteristic line of the reversal direction, which expresses a relationship between a rotational position of the stepping motor and the opening degree of the variable throttle valve at time when the stepping motor is caused to rotate in the reversal direction, and is anticipated that the excess air ratio of the air-fuel mixture will become a regulation standard-value which deviates from the acceptable range by a fixed quantity in a changed direction at time when the opening degree of the variable throttle valve is caused to change to the above-mentioned other, next, causes the stepping motor to rotate from the first standard rotational-position in the normal-rotation direction till a second standard rotational-position that is calculated based on a change characteristic line of the normal-rotation direction, which expresses a relationship between the rotational position of the stepping motor and the opening degree of the variable throttle valve at time when the stepping motor is caused to rotate in the normal-rotation direction, and reaches a short, by a predetermined angle in the normal-rotation direction, of a target rotational-position which is anticipated that the excess ratio of the air-fuel mixture will become the appropriate value, and subsequently, at the state where the stepping motor is caused to rotate by the predetermined unit-angle in the normal-rotation direction, repeatedly distinguishes whether the excess air ratio of the air-fuel mixture, which is detected by the detecting device, has become the appropriate value until the excess air ratio of the air-fuel mixture, which is detected by the excess air ratio detecting device, becomes the appropriate value.

According to the invention, in the case where the excess air ratio of the air-fuel mixture, which is detected by the excess air ratio detecting device, deviates from the acceptable range to such a side as the excess air ratio will become the appropriate value by causing the opening degree of the variable throttle valve to change to the above-mentioned one, while distinguishing whether the excess air ratio of the air-fuel mixture, which is detected by the detecting device, has become the appropriate value, by repeating to cause the stepping motor to rotate in the normal-rotation direction by the predetermined unit-angle, it can take a little time for the variable throttle valve to be regulated so that the excess air ratio of the air-fuel mixture becomes the appropriate value. Additionally, in the case where the excess air ratio of the air-fuel mixture, which is detected by the excess air ratio detecting device, deviates from the acceptable range to such a side as the excess air ratio will become the appropriate value by causing the opening degree to change to the above-mentioned other, by causing the stepping motor to rotate till the second standard rotational-position in the normal-rotation direction after causing the stepping motor to rotate till the first standard rotational-position in the reversal direction, even if the rotational angle by the hysteresis amount in the reversal direction is changed due to a change of the hysteresis amount, the change of the rotational angle can be cancelled by a change of the rotational angle by the hysteresis amount in the normal-rotation direction. Therefore, when the stepping motor is caused to rotate to the second standard rotational-position in the normal-rotation direction, the opening degree of the variable throttle valve will become an opening degree corresponding to the second standard rotational-position that is defined by the change characteristic line of the normal-direction without any influence by the change of the hysteresis amount and the opening degree does not excessively change to the above-mentioned one. Accordingly, even in the case where the excess air ratio of the air-fuel mixture, which is detected by the excess air ratio detecting device, deviates from the acceptable range to such a side as the excess ratio will become the appropriate value by causing the opening degree of the variable throttle valve to the above-mentioned other, by causing the stepping motor to quickly rotate to the first standard rotational-position and the second standard rotational-position and, subsequently, repeating to cause the stepping motor to rotate from the second standard rotational-position in the normal-direction by the predetermined unit-angle while distinguishing whether the excess air ratio of the air-fuel mixture, which is detected by the excess air ratio detecting device, has become the appropriate value, it can take a little time to regulate the variable throttle valve so that the excess air ratio of the air-fuel mixture becomes the appropriate value. That is, much time that is took for the regulation of the variable throttle valve due to the change of the hysteresis amount can be prevented.

Additionally, in the invention, it is desirable that the control device is configured to carry out a fifth control that, in a case where the excess air ratio of the air-fuel mixture is detected by the excess air ratio detecting device at a state where the stepping motor has been caused to rotate till the first standard rotational-position in the reversal direction and the detected excess air ratio of the air-fuel mixture has not become the regulation standard-value, corrects the first standard rotational-position based on the change characteristic line of the reversal direction so that the excess air ratio of the air-fuel mixture becomes the regulation standard-value. According to the fifth control, even if the opening degree of the variable throttle valve when the stepping motor is caused to rotate to the first standard rotational-position is changed due to the change of the hysteresis amount and the excess air ratio of the air-fuel mixture deviates from the regulation standard-value, by correction of the first standard rotational-position, when the stepping motor is next caused to rotate to the first standard rotational-position, the excess air ratio of the air-fuel mixture will become the appropriate value and considerable deterioration of a combustion state of the burner can be prevented.

Incidentally, the excess air ratio detecting device can be constituted by a flame rod that is inserted into flames which are generated at the burner and detects a flame current value. The flame current value becomes maximum when the excess air ratio of the air-fuel mixture is 1.0 and decreases accompanied by an increase and a decrease of the excess air ratio from 1.0. In a case where the change of the opening degree of the variable throttle valve to the above-mentioned other is a change that causes the opening degree to decrease, if the excess air ratio of the air-fuel mixture is smaller than 1.0 and leads to a gas-rich state, when the opening degree of the variable throttle valve is caused to decrease by causing the stepping motor to rotate till the first standard rotational-position in the reversal direction, the excess air ratio of the air-fuel mixture will increase toward 1.0 and the flame current will increase. Additionally, in a case where the change of the opening degree of the variable throttle valve to the above-mentioned other is a change that causes the opening degree to increase, if the excess air ratio of the air-fuel mixture is smaller than 1.0 and leads to the gas-rich state, when the opening degree of the variable throttle valve is caused to increase by causing the stepping motor to rotate till the first standard rotational-position in the reversal direction, the excess air ratio of the air-fuel mixture will decrease much smaller and the flame current value will decrease.

Then, in the case where the excess air ratio detecting device is constituted by the flame rod, it is desirable that the control device is configured to a sixth control that, when the stepping motor is caused to rotate till the first standard rotational-position in the reversal direction, in the case where the change of the opening degree of the variable throttle valve to the above-mentioned other is a change that causes the opening degree to decrease and when the flame current value that is detected by the flame rod increases, and in the case where the change of the opening degree of the variable throttle valve to the above-mentioned other is a change that causes the opening degree to increase and when the flame current value that is detected by the flame rod decreases, carries out decision of abnormality and suspension by an error, which suspends combustion of the burner. According to the sixth control, in the case where the excess air ratio of the air-fuel mixture is smaller than 1.0, the suspension by the error can be carried out and this makes safe.

DESCRIPTION OF EMBODIMENTS

Figure 1:
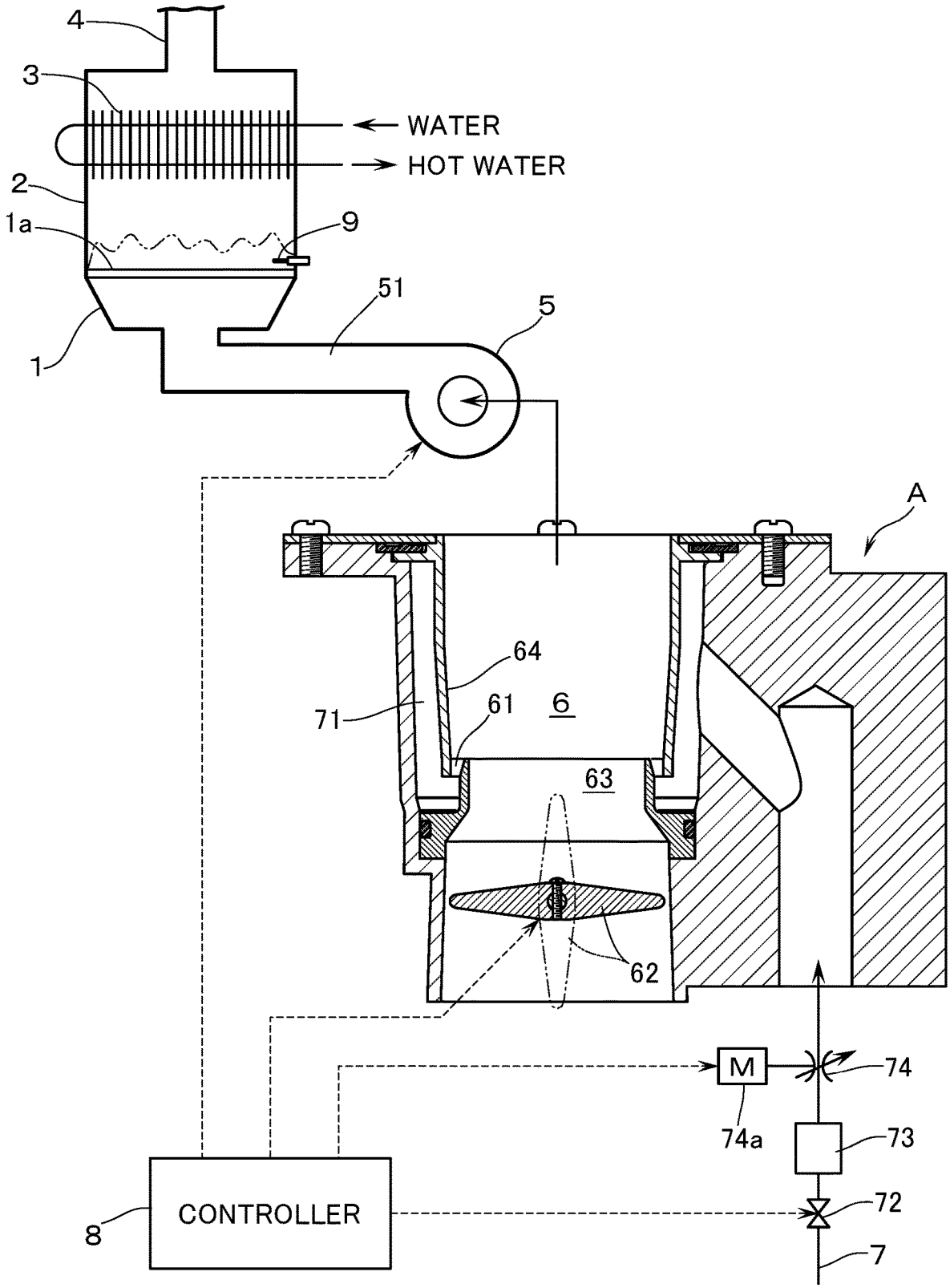
FIG. 1 is an explanation diagram that shows a premixing apparatus of an embodiment according to the invention and a combustion apparatus that includes a burner to which an air-fuel mixture from the premixing apparatus is supplied.

A combustion apparatus that is shown in FIG. 1 is a heat resource apparatus that includes a totally aerated combustion burner 1, a combustion box 2 that encloses a combustion space of an air-fuel mixture that ejects from a combustion surface 1*a* of the burner 1, and a heat exchanger 3 that is disposed in the combustion box 2. A combustion gas that is generated by combustion of the air-fuel mixture heats the heat exchanger 3 and thereafter is exhausted outside through a combustion tube 4 that is connected to an end portion of the combustion box 2. Additionally, by a premixing apparatus A of an embodiment according to the invention, a fuel gas is mixed with air and the air-fuel mixture is supplied to the burner 1 through a fan 5 and an air-fuel mixture supply passage 51 on a downstream side of the fan 5.

The premixing apparatus A includes an air supply passage 6 on an upstream side of the fan 5, a gas supply passage 7 that supplies the fuel gas, the fan 5, and a controller 8 as a control devise that controls a butterfly valve 62, a main valve 72 and a variable throttle valve 74 that will be mentioned below. A downstream end of the gas supply passage 7 is connected to a gas suction part 61 that is arranged in the air supply passage 6. In a portion of the air supply passage 6, which is adjacent to an upstream side of the gas suction part 61, a venturi part 63 with a diameter smaller than that of a portion in which the butterfly valve 62 is arranged. A portion of the air supply passage 6, which is adjacent to a downstream side of the venturi part 63, is enclosed by a tubular part 64 with a diameter larger than that of the venturi part 63. Then, a downstream end portion of the venturi part 63 is inserted into an upstream end portion of the tubular part 64 while leaving an annular clearance and the gas suction part 61 is constituted by the clearance. At the downstream end of the gas supply passage 7, a gas chamber 71 that communicates with the gas suction part 61 is provided in a manner to enclose the tubular part 64. Additionally, in the gas supply passage 7, from an upstream side downward in sequence, the main valve 72, a zero governor 73 that regulates a secondary gas pressure to an atmospheric pressure, and the variable throttle valve 74 that is driven by a stepping motor 74*a* are interposed.

An amount of the fuel gas that is supplied through the gas suction part 61 varies depending on a differential pressure between the atmospheric pressure that is the secondary gas pressure and a negative pressure that acts upon the gas suction part 61. Here, the negative pressure that acts upon the gas suction part 61 varies with a rotational speed of the fan 5. Therefore, a supply amount of the fuel gas varies in proportion to the rotational speed of the fan 5, i.e., a supply amount of air. Additionally, a ratio of the supply amount of the fuel gas to the supply amount of the air varies with an opening degree of the variable throttle valve 74. By changing the opening degree of the variable throttle valve 74 to a predetermined standard opening-degree corresponding to a kind of a gas to be used, an excess air ratio of an air-fuel mixture becomes a predetermined appropriate value (for example, 1.3). By controlling the rotational speed of the fan 5 corresponding to a required combustion amount (a combustion amount that is necessary to deliver hot water at a set temperature), the air-fuel mixture with the appropriate value of the excess air ratio and in amount corresponding to the required combustion amount is supplied to the burner 1.

In order that poor combustion does not occur due to entry of a wind into the exhaust tube 4, that is, in order to secure a wind-resistant performance, a lower-limit rotational speed of the fan 5 cannot be set to be considerably slow. In a case where the required combustion amount decreases a predetermined value that corresponds to the lower-limit rotational speed, or smaller, air in amount corresponding to the required combustion amount cannot be supplied.

Then, in a portion, on the upstream side of the gas suction part 61, of the air supply passage 6, in order to switch a flow resistance of the portion in question to two stages of which one is large and the other is small, the butterfly valve 62 that can be switched to a closed posture that is shown by a full line and an opened posture that is shown by an imaginary line in FIG. 1 is disposed. In a case where the required combustion amount decreases to the predetermined value or smaller, by switching the butterfly valve 62 to the closed posture, the flow resistance of the air supply passage 6 makes large so that the air in amount corresponding to a required combustion amount of the predetermined value or smaller can be supplied without causing the rotational speed of the fan 5 to decrease to a lower-limit rotational speed or slower. Provided that the air-flow resistance is only made large by the switching the butterfly valve 62 to the closed posture, since the negative pressure in the air supply passage 6 increases, the supply amount of the fuel gas will become excessive and the excess air ratio of the air-fuel mixture that is supplied to the burner 1 will become below the appropriate value. Therefore, in a case where the required combustion amount is relatively small, a combustion capacity is changed to a small capacity state in which not only the butterfly valve 62 is switched to the closed posture and the flow resistance of the air supply passage 6 is made large but also the variable throttle valve 74 is tightened from a standard opening-degree by a predetermined opening degree and the flow resistance in a portion, on a downstream side of the zero governor 73, of the gas supply passage 7 is made large, the air-fuel mixture with the appropriate value of the excess air ratio and in amount corresponding to the relatively small required combustion is made sure to be supplied to the burner 1. Additionally, in a case where the required combustion amount is relatively large, the combustion capacity is changed to a large capacity state in which not only the butterfly valve 62 is switched to the opened posture and the flow resistance of the air supply passage 6 is made small but also the variable throttle valve 17 is opened till the standard opening-degree and the flow resistance in the portion, on the downstream side of the zero governor 73, of the gas supply passage 7 is made small, the air-fuel mixture with the appropriate value of the excess air ratio and in amount corresponding to the relatively large required combustion amount is made sure to be supplied to the burner 1.

Further, even if a same kind of a gas is used as the fuel gas, a calorific amount (Wobbe Index) sometimes varies with time. In this case, if a ratio of the supply amount of the fuel gas to the supply amount of the air is constant, the excess air ratio of the air-fuel mixture will fluctuate due to fluctuation of the calorific amount of the fuel gas, the poor combustion will occur.

Figure 2:
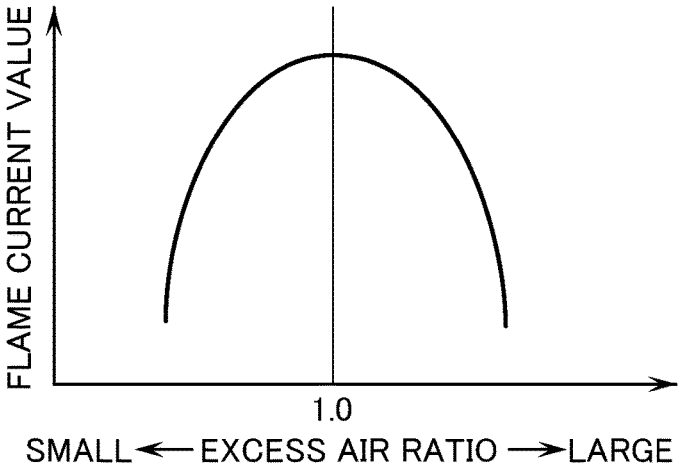
FIG. 2 is a graph that shows a relationship between an excess air ratio of the air-fuel mixture and a flame current value that is detected by a flame rod.

Then, an excess air ratio detecting device that detects the excess air ratio of the air-fuel mixture is provided. In the embodiment, the excess air ratio detecting device is constituted by a flame rod 9 that is inserted into flames which are generated at the burner 1 and that detects a flame current value. As shown in FIG. 2, the flame current value becomes maximum when the excess air ratio of the air-fuel mixture is 1.0 and decreases accompanied by an increase and a decrease from the excess air ratio of 1.0. Accordingly, the excess air ratio of the air-fuel mixture can be detected based on the flame current value that is detected by the flame rod 9. A detected signal of the excess air ratio is inputted in the controller 8 and the controller 8 carries out controls that regulate the opening degree of the variable valve 74 so that a detected excess air ratio becomes the appropriate value.

Figure 3:
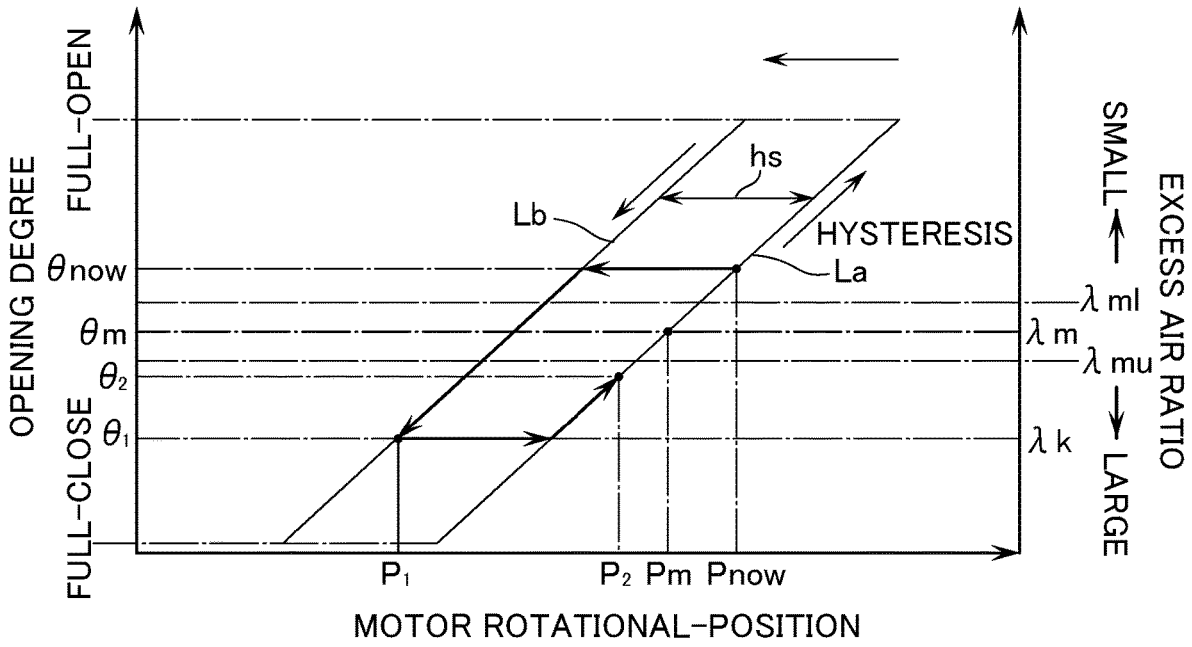
FIG. 3 a graph that shows a relationship between a rotational position of a stepping motor that drives a variable throttle valve and an opening degree of the throttle valve, and the excess air ratio of the air-fuel mixture.

The controls of opening-degree regulation of the variable throttle valve 74 will be explained below. In the embodiment, regarding a change character that expresses a relationship between a rotational position of the stepping motor 74*a* that drives the variable throttle valve 74 and the opening-degree of the variable throttle valve 74, a rotational direction of the stepping motor 74*a*, which causes the opening degree of the variable throttle valve 74 to change in an increasing direction, is defined as a normal-rotation direction and a rotational direction of the stepping motor 74*a*, which causes the opening degree of the variable throttle valve 74 to change in a decreasing direction, is defined as a reversal direction. A change characteristic lime in the normal-rotation direction, which expresses a relationship between the rotational position of the stepping motor 74*a* and the opening degree of the variable throttle valve 74, when the stepping motor 74*a* is caused to rotate in the normal-rotation direction becomes a line that is expressed by La in FIG. 3. A change characteristic line of the reversal direction, which expresses a relationship between the rotational position of the stepping motor 74*a* and the opening degree of the variable throttle valve 74, when the stepping motor 74*a* is caused to rotate in the reversal direction becomes a line that is expressed by Lb in FIG. 3, which deviates from the change characteristic line of the normal-rotation direction by a hysteresis amount hs in the reversal direction due to backlash of mechanism between the stepping motor 74*a* and a valve body of the variable throttle valve 74. Additionally, as the opening degree of the variable throttle valve 74 is caused to increase, the excess air ratio of the air-fuel premixture decreases and as the opening degree of the variable throttle valve 74 is caused to decrease, the excess air ratio of the air-fuel mixture increases. In an example as shown in FIG. 3, the opening degree of the variable throttle valve 74 when the excess air ratio of the air-fuel mixture is the appropriate value $\lambda m$ becomes $\theta m$. Incidentally, numeric for specifying the change characteristic lines La, Lb including inclinations of the change characteristic lines La, Lb in the normal-rotation and reversal directions are memorized in the controller 8.

Figure 4:
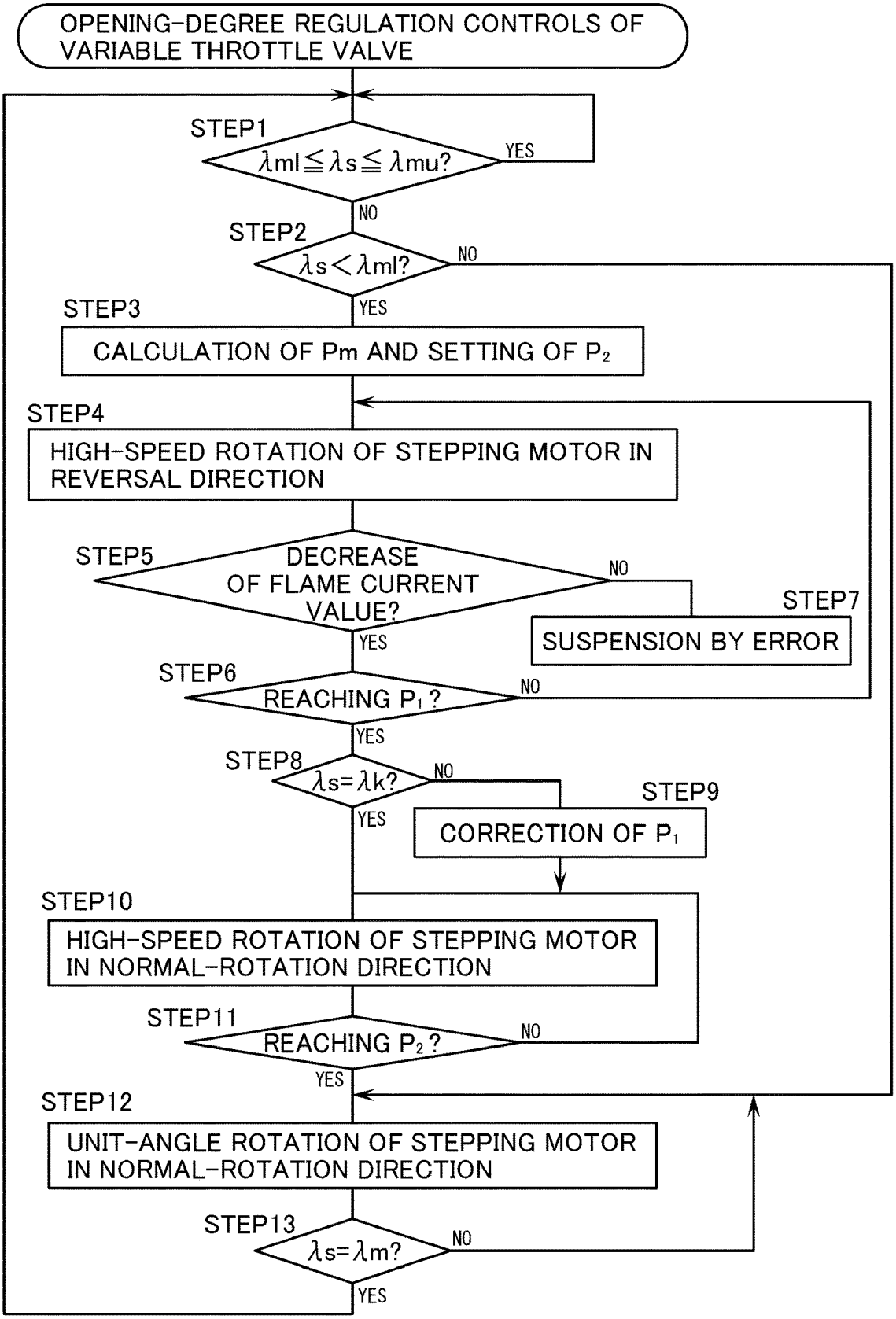
FIG. 4 is a flow diagram that shows contents of opening-degree regulation controls of the variable throttle valve, which a control device of the premixing apparatus of the embodiment carries out.

Referring to FIG. 4, the controls of the opening-degree regulation of the variable throttle valve 74 are explained below. In the controls, first, in STEP 1, a distinction whether the excess air ratio $\lambda s$ of the air-fuel mixture, which is detected based on a detected flame current value by the flame rod 9, (hereinafter referred to a detected excess air ratio) falls within a predetermined acceptable range including the appropriate value $\lambda m$, that is, on a premise that each of lower and upper limits of the acceptable range is $\lambda ml$, $\lambda mu$, a distinction whether $\lambda ml \leq \lambda s \leq \lambda mu$, is carried out. In a case of being out of the acceptable range, in STEP 2, a distinction whether the detected excess air ratio $\lambda s$ will become the appropriate value $\lambda m$ by causing the opening degree of the variable throttle valve 74 to change in a decreasing direction, that is, whether the detected excess air ratio λs is below the lower limit λml of the acceptable range, is carried out. Then, if each of a present rotational position of the stepping motor 74*a* and a present opening degree of the variable throttle valve 74 is Pnow, θnow in FIG. 3 and the detected excess air ratio λs is below the lower limit λml, controls will proceed to STEP 3.

In STEP 3, based on the change-characteristic line La in the normal-rotation direction, a target rotational-position Pm that is anticipated that the excess air ratio of the air-fuel mixture will become the appropriate value λm is calculated by a following equation.

$$Pm = Pnow - (\lambda m - \lambda s)/\text{inclination of change characteristic line}$$

Then, a position before reaching the target rotational-position Pm by a predetermined amount in the normal-rotation direction, e.g., a position before reaching the target rotational-position Pm by 10% of a rotational angle from a full closed-position to the target rotational-position Pm is set to be a second standard rotational-position $P_2$. Further, a predetermined first standard rotational-position $P_1$ that is anticipated that the excess air ratio of the air-fuel mixture will become a regulation standard-value λk (for example, 1.45) that deviates from the acceptable range by a fixed quantity in a changing direction, i.e., in an increasing direction at time when the opening degree of the variable throttle valve 74 is caused to change in the decreasing direction is preset based on the change characteristic line Lb of the reversal direction.

When processing in STEP 3 is finished, in STEP 4, a high-speed rotation of the stepping motor 74*a* in the reversal direction is begun. Next, in STEP 5, a distinction whether the flame current value that is detected by the flame rod 9 decreases is carried out. If the flame current value decreases, in STEP 6, a distinction whether the rotational position of the stepping motor 74*a* reaches the first standard rotational-position $P_1$ is carried out and processing in STEPs 4-6 is repeated till reaching the first standard rotational-position $P_1$. Here, if the excess air ratio is smaller than 1.0 and leads to a gas-rich state, when the stepping motor 74*a* is caused to rotate till the first standard rotational-position $P_1$ in the reversal direction and the opening degree of the variable throttle valve 74 is caused to decrease, the excess air ratio of the air-fuel mixture increases toward 1.0 and the flame current value increases. In this case, in STEP 5, it is distinguished that the flame current value has increased, and in STEP 7, abnormality is decided and suspension by an error that suspends combustion of the burner 1 is carried out. Therefore, continuous combustion in the state where the excess air ratio of the air-fuel mixture is smaller than 1.0 can be prevented and this makes safe.

When the stepping motor 74*a* is caused to rotate at a high speed till the first standard rotational-position $P_1$ in the reversal direction, in STEP 8, a distinction whether the detected excess air ratio λs has become the regulation standard-value λk is carried out. If λs≠λk, in STEP 9, the first standard rotational-position $P_1$ is corrected based on the change characteristic line Lb of the reversal direction according to the following equation so that the excess air ratio of the air-fuel mixture becomes the regulation standard-value λk.

$$P_1 = \text{present } P_1 - (\lambda k - \lambda s)/\text{inclination of change characteristic line}$$

Subsequently, the controls proceed to STEP 10. If λs=λk, the controls directly proceed from STEP 8 to STEP 10.

Here, when the stepping motor 74*a* is caused to rotate from a position of Pnow to the first standard rotational-position $P_1$ in the reversal direction, the opening degree of the variable throttle valve 74 will not be changed until a rotational angle from beginning of rotation reaches the hysteresis amount hs. In the hysteresis amount hs, there is an individual difference and the hysteresis amount hs varies with time. Therefore, the opening degree $\theta_1$ of the variable throttle valve 74 at time when the rotational position of the stepping motor 74*a* reaches the first standard rotational-position $P_1$ is changed by a change of the hysteresis amount and the excess air ratio of the air-fuel mixture deviates from the regulation standard-value λk. By correcting the first standard rotational-position $P_1$ of the stepping motor 74*a*, as above-mentioned, when the stepping motor 74*a* is next caused to rotate to the first standard rotational-position $P_1$, the excess air ratio of the air-fuel mixture will become regulation standard-value λk and considerable deterioration of combustion state of the burner 1 can be prevented.

In STEP 10, a high-speed rotation of the stepping motor 74*a* from the first standard rotational-position $P_1$ in the normal-rotation direction is begun. The high-speed rotation of the stepping motor 74*a* in the normal-rotation direction is continued until it is distinguished that the rotational position of the stepping motor 74*a* reaches the second standard rotational-position $P_2$ in STEP 11. Next, in STEP 12, after the stepping motor 74*a* is caused to rotate by a redetermined unit-angle in the normal-rotation direction, in STEP 13, a distinction whether the detected excess air ratio λs has become the appropriate value λm is carried out. The processing in STEPs 12, 13 is repeated till λs=λm. Additionally, when it is also distinguished that the detected excess air ratio λs is beyond the upper limit λmu of the acceptable range in STEP 2, the processing of STEPs 12, 13 is repeated till λs=λm.

Here, when the stepping motor 74*a* is caused to rotate till the first standard rotational-direction $P_1$, even if the rotational angle by the hysteresis amount hs in the reversal direction is changed due to the change of the hysteresis amount hs, the change of the rotational angle is cancelled by the change of the rotational angle by the hysteresis amount hs in the normal-rotation amount when the stepping motor 74*a* is caused to rotate till the second standard rotational-position $P_2$ in the normal-rotation direction. Accordingly, when the stepping motor 74*a* is caused to rotate till the second standard rotational-position $P_2$ in the normal-rotation direction, the opening degree of the variable throttle valve 74, without any influence of the change of the hysteresis amount hs, will become an opening degree $\theta_2$ corresponding to the second standard rotational-position $P_2$ that is defined by the change characteristic line La of the normal-rotation direction. Therefore, the opening degree of the variable throttle valve 74 is not excessively changed in the increasing direction. Subsequently, by repeating to cause the stepping motor 74*a* to rotate from the second standard rotational-position $P_2$ by the predetermined unit-angle in the normal-rotation direction while distinguishing whether the detected excess air ratio λs has become the appropriate value λm, it cannot take much time to regulate the variable throttle valve 74 so that the excess air ratio of the air-fuel mixture becomes the appropriate value λm. That is, much time that is took for regulation of the variable throttle valve 74 due to the change of the hysteresis amount hs can be prevented.

The embodiment of the invention is explained referring to figures in the above. On the other hand, the invention is not restricted to the above-mentioned embodiment. For example, the normal-rotation and reversal directions of the stepping motor 74*a* may be set, in a reversal manner of the embodiment, to rotational directions to cause the opening degree of the stepping motor 74*a* to change in the decreasing and increasing directions, respectively. In this case, in the case where the detected excess air ratio λs that has been a value that is out of the acceptable range and will become the appropriate value λm by causing the opening degree of the variable throttle valve 74 in the decreasing direction, that is, in the case where the detected excess air ratio λs is below the lower limit λml of the acceptable range, the controls proceed to STEP 12, and in the case where the detected excess air ratio λs is above the upper limit λmu of the acceptable range, the controls proceed STEP 3. Additionally, in STEP 5, a distinction whether the flame current value increases is carried out, when the flame current value decreases, in STEP 7, the suspension by the error is carried out.

Further, the excess air ratio detecting device can be also constituted by any other device than the flame rod 9 in the embodiment. That is, since the flames move forward and away from the combustion surface 1*a* depending on the excess air ratio of the air-fuel gas, a rear-surface temperature of the combustion surface 1*a* varies depending on the excess air ratio of the air-fuel mixture. Accordingly, the excess air ratio detecting device may be also constituted by a temperature sensor that detects the rear-surface temperature of the combustion surface 1*a*. Additionally, in the embodiment, though the butterfly valve 62 is arranged in the portion, on the upstream side of the gas suction part 61, of the air supply passage 6, the butterfly valve may be also omitted.

EXPLANATION OF SYMBOLS

A Premixing apparatus
1 Burner
5 Fan
6 Air supply passage
61 Gas suction part
7 Gas supply passage
73 Zero governor
74 Variable throttle valve
74*a* Stepping motor
8 Controller (Control device)
9 Flame rod (Excess air ratio detecting device)
La Change characteristic line of normal-rotation direction
Lb Change characteristic line of reversal direction
λm Appropriate value of excess air ratio
λk Regulation standard-value
$P_1$ First standard rotational-position
$P_2$ Second standard rotational-position
Pm Target rotational-position

What is claimed is:

1. A premixing apparatus that mixes a fuel gas with air and supplies an air-fuel mixture to a burner through a fan, comprising:

an air supply passage on an upstream side of the fan;

a gas supply passage of which a downstream end is connected to a gas suction part that is arranged in the air supply passage;

a zero governor that is interposed in the gas supply passage and regulates a secondary gas pressure to an atmospheric pressure;

a variable throttle valve that is interposed in a portion, on a downstream side of the zero governor, of the gas supply passage and is driven by a stepping motor;

an excess air ratio detecting device that detects an excess air ratio of the air-fuel mixture; and a control device, wherein the control device is configured to carry out a first control that is able to change a rotational speed of the fan depending on a required combustion amount and a second control that regulates an opening degree of the variable throttle valve so that the excess air ratio of the air-fuel mixture, which is detected by the excess air ratio detecting device, becomes a predetermined value, wherein:

on a premise that a rotational direction of the stepping motor, which causes the opening degree of the variable throttle valve to change to one of an increase and a decrease, is defined as a normal-rotation direction and a rotational direction of the stepping motor, which causes the opening degree of the variable throttle valve to change to the other of the increase and the decrease, is defined as a reversal direction, the control device is configured to carry out: a third control as the second control, which, in a case where the excess air ratio of the air-fuel mixture, which is detected by the excess air ratio detecting device, has been a value that is out of a predetermined acceptable-range which includes the appropriate value and will become the appropriate value by causing the opening degree of the variable throttle valve to change to the above-mentioned one, at a state where the stepping motor has been caused to rotate by a predetermined unit-angle in the normal-rotation direction, repeatedly distinguishes whether the excess air ratio of the air fuel mixture, which is detected by the excess air ratio detecting device, has become the appropriate value until the excess air ratio of the air-fuel mixture, which is detected by the excess air ratio detecting device, becomes the appropriate value; and a fourth control as the second control, which, in a case where the excess air ratio of the air-fuel mixture, which is detected by the excess air ratio detecting device, has been a value that is out of the acceptable-range and will become the appropriate value by causing the opening degree of the variable throttle valve to change to the above-mentioned other, causes the stepping motor to rotate in the reversal direction till a predetermined first standard rotational-position that is set based on a change characteristic line of the reversal direction, which expresses a relationship between a rotational position of the stepping motor and opening degree of the variable throttle valve at time when the stepping motor is caused to rotate in the reversal direction, and is anticipated that the excess air ratio of the air-fuel mixture will become a regulation standard-value which deviates from the acceptable range by a fixed quantity in a changed direction at time when the opening degree of the variable throttle valve is caused to change to the above-mentioned other, next, causes the stepping motor to rotate from the first standard rotational-position in the normal-rotation direction till a second standard rotational-position that is calculated based on a change characteristic line of the normal-rotation direction, which expresses a relationship between the rotational position of the stepping motor and the opening degree of the variable throttle valve at time when the stepping motor is caused to rotate in the normal-rotation direction, and reaches a short, by a predetermined angle in the normal-rotation direction, of a target rotational-position which is anticipated that the excess ratio of the air-fuel mixture will become the appropriate value, and subsequently, at the state where the stepping motor is caused to rotate by the predetermined unit-angle in the normal-rotation direction, repeatedly distinguishes whether the excess air ratio of the air-fuel mixture, which is detected by the detecting device, has become the appropriate value until the excess air ratio of the air-fuel mixture, which is detected by the excess air ratio detecting device, becomes the appropriate.

2. The premixing apparatus as claimed in claim 1, wherein the control device is configured to carry out a fifth control that, in a case where the excess air ratio of the air-fuel mixture is detected by the excess air ratio detecting device at a state where the stepping motor has been caused to rotate till the first standard rotational-position in the reversal direction and the detected excess air ratio of the air-fuel mixture has not become the regulation standard-value, and corrects the first standard rotational-position based on the change characteristic line of the reversal direction so that the excess air ratio of the air-fuel mixture becomes the regulation standard-value.

3. The premixing apparatus as claimed in claim 1, wherein the excess air ratio detecting device is constituted by a flame rod that is inserted into flames that are generated at the burner and detects a flame current value, wherein:

the control device is configured to a sixth control that, when the stepping motor is caused to rotate till the first standard rotational-position in the reversal direction, in the case where the change of the opening degree of the variable throttle valve to the above-mentioned other is a change that causes the opening degree to decrease and when the flame current value that is detected by the flame rod increases, and in the case where the change of the opening degree of the variable throttle valve to the above-mentioned other is a change that causes the opening degree to increase and when the flame current value that is detected by the flame rod decreases, carries out decision of abnormality and suspension by an error, which suspends combustion of the burner.

* * * * *